US006632099B2

(12) United States Patent
Rygwelski, Jr. et al.

(10) Patent No.: US 6,632,099 B2
(45) Date of Patent: Oct. 14, 2003

(54) ELECTRICAL CONNECTOR WITH AUTOMATIC SHUNT DISPLACEMENT MEMBER

(75) Inventors: Richard Ernest Rygwelski, Jr., Grosse Pointe City, MI (US); Kenneth Alan York, Eastpointe, MI (US); Ron R. Sexton, Brighton, MI (US); Igor Tolkachier, Novi, MI (US); Dean Grider, Clinton Township, MI (US); Berlinda Qingxi Bai, Troy, MI (US)

(73) Assignee: ATI Systems, Inc., Warren, MI (US)

( * ) Notice: Subject to any disclaimer, the term of this patent is extended or adjusted under 35 U.S.C. 154(b) by 0 days.

(21) Appl. No.: 09/989,296

(22) Filed: Nov. 20, 2001

(65) Prior Publication Data

US 2002/0072262 A1 Jun. 13, 2002

(Under 37 CFR 1.47)

Related U.S. Application Data

(60) Provisional application No. 60/252,240, filed on Nov. 21, 2000.

(51) Int. Cl.[7] ..... H01R 29/00

(52) U.S. Cl. ..... 439/188; 324/538; 439/482

(58) Field of Search ..... 439/482, 188, 439/911; 200/51.1; 324/538

(56) References Cited

U.S. PATENT DOCUMENTS

| | | | | | |
|---|---|---|---|---|---|
| 4,907,342 | A | * | 3/1990 | Castonguay et al. | 29/622 |
| 4,943,890 | A | * | 7/1990 | Schaltenbrand et al. | 361/709 |
| 5,516,300 | A | * | 5/1996 | Tsuji | 439/188 |
| 5,781,016 | A | * | 7/1998 | Maeda | 324/538 |
| 5,899,762 | A | | 5/1999 | Ainceri | 439/157 |
| 6,155,855 | A | | 12/2000 | Weil et al. | 439/189 |

* cited by examiner

*Primary Examiner*—Neil Abrams
*Assistant Examiner*—Phuong Dinh
(74) *Attorney, Agent, or Firm*—Gifford, Krass, Groh, Sprinkle, Anderson & Citkowski, P.C.

(57) ABSTRACT

A connector for testing shunted electrical terminal assemblies includes a selectively actuatable shunt displacement member for moving a terminal shunt between a shunted and unshunted position in response to a control signal. The connector allows for the testing of shunted circuits and connectors in a shunted and unshunted position. The connector is readily adaptable to systems for automated testing of airbag actuators and the like.

17 Claims, 3 Drawing Sheets

ELECTRICAL CONNECTOR WITH AUTOMATIC SHUNT DISPLACEMENT MEMBER

RELATED APPLICATION

This patent claims priority of Provisional Patent Application Serial No. 60/252,240 filed Nov. 21, 2000 and entitled "Electrical Connector with Automatic Shunt Displacement Member."

FIELD OF THE INVENTION

This invention relates generally to electrical connectors. More specifically, the invention relates to electrical connectors which are configured to mate with shunted electrical terminals, and which include a shunt displacement member for selectably deshunting the terminals.

BACKGROUND OF THE INVENTION

Electrical terminals associated with circuits for activating explosive devices such as airbag detonators, pyrotechnic actuators and the like often include a shunting member for preventing inadvertent activation of the circuit. The shunting member is disposed so as to establish electrical contact between selected portions of the circuit thereby deactivating the circuit and preventing activation of the explosive device. In most instances, shunted terminals are configured so that a fixed projection in a mating connector displaces the shunt member at the time final connection of the circuitry is made.

Automobiles and other motor vehicles typically include a number of detonators for activating airbags and tensioning seat belts in the event of a crash. These explosive devices can present a hazard during the assembly and testing of motor vehicles should they be inadvertently deployed. Consequently, it is standard practice in the industry to include one or more shunting members in the activation circuitry for such devices. These shunts are disposed so as to short out or ground the activation circuitry and prevent inadvertent detonation as a result of accumulated static electricity, improper connection or the like.

In the course of assembling motor vehicles, it is necessary to test the airbag and seat belt tensioning circuitry to verify that it has been properly installed and is functional. Such testing requires displacement of the shunting members. Furthermore, testing generally requires that circuits are tested both with the shunts in place and with various of the shunts removed. Previously, testing of terminals in a shunted and unshunted condition required a testing protocol in which two separate connections were sequentially made to the shunted terminal. In this approach, a first connection would be made with a connector not having a shunt displacement member, so as to allow data collection from the shunted circuit. A second connection would then be made employing another connector having a shunt displacement member, and data would be collected on the unshunted circuitry. This approach required sequential connections to be made and broken thereby requiring significant labor and introducing numerous sources of error. In addition, this approach is very impractical in the situation where activation circuitry may include a number of separately shunted terminals which must be tested under conditions wherein different combinations of shunted and unshunted terminals are required.

One approach to simplifying the testing of shunted terminals is shown in U.S. Pat. No. 6,155,855. This patent discloses a test connector for use in conjunction with shunted terminals. The connector is configured to engage a shunted terminal in one of two positions. In a first position wherein the connector is only partially seated with the terminal, electrical communication with the terminal is established, but the shunt member is not displaced. The connector of the '855 patent may then be moved to a fully seated position wherein a shunt displacement member engages and displaces the shunt thereby permitting measurements to be made on the unshunted circuit. While this device overcomes some of the problems of the prior art, it still requires two separate mechanical manipulations of the connector and terminal. In addition, electrical connection in the partially engaged state can be erratic. Furthermore, connectors of this type do not allow for rapid, selectable shunt member displacement, and are not advantageous for use in situations where a plurality of measurements are being made on a number of combinations of shunted terminals.

Accordingly, there is a need for a connector which can establish electrical communication with a shunted terminal assembly, and which is capable of automatically displacing the shunting member. The connector should be capable of providing for the displacement and replacement of the shunting member, without requiring the connection to the terminal assembly to be interrupted. Most preferably, the shunting and deshunting action should be controllable by an electronic or fluidic circuit. As will be explained in detail hereinbelow, the present invention provides a connector which meets these criteria. The connector of the present invention is simple to operate, rapid in action, and capable of repeatedly displacing and replacing a shunting member. As such, the connector of the present invention is readily adaptable to a variety of test equipment and procedures. These and other advantages of the invention will be apparent from the drawings, discussion and description which follow.

BRIEF DESCRIPTION OF THE INVENTION

Disclosed herein is a connector for establishing electrical communication with a shunted electrical terminal of the type comprising a terminal housing having supported therein an electrically conductive terminal member and an electrically conductive shunt member. The shunt member is movable from a first, shunting, position in which it is in electrical communication with the terminal member to a second, unshunted, position where it is not in electrical communication with the terminal member. The connector of the present invention includes a connector housing which is configured to mechanically engage the terminal housing. The connector further includes an electrically conductive contact member supported by the connector housing. The contact member is disposed and configured to engage, and establish electrical contact with, the terminal member when the connector housing is in mechanical engagement with the terminal housing. The contact member also includes a shunt displacement member which is supported by the connector housing. The shunt displacement member is selectively activatable when the connector housing is in mechanical engagement with the terminal housing, to move the shunt member from the shunting position to the unshunted position.

In specific embodiments of the present invention, the displacement member is electrically activatable to move the shunt member, and in such instances may include a solenoid or linear actuator. In other embodiments, the displacement member may be fluidically activatable, as for example by a pneumatic or hydraulic system.

The connector of the present invention is particularly suited for use in connection with a test circuit, such as a test circuit for testing a pyrotechnical actuator. The present invention also includes a method for testing a shunted terminal, which method employs the connector of the present invention.

DETAILED DESCRIPTION OF THE INVENTION

The present invention comprises a connector which is configured to engage a shunted electrical terminal, and which includes a shunt displacement member which is selectively activatable so as to cause displacement of the shunt member. The connector of the present invention may be implemented in a number of different configurations, and some specific embodiments thereof will be discussed hereinbelow.

Figure 1:
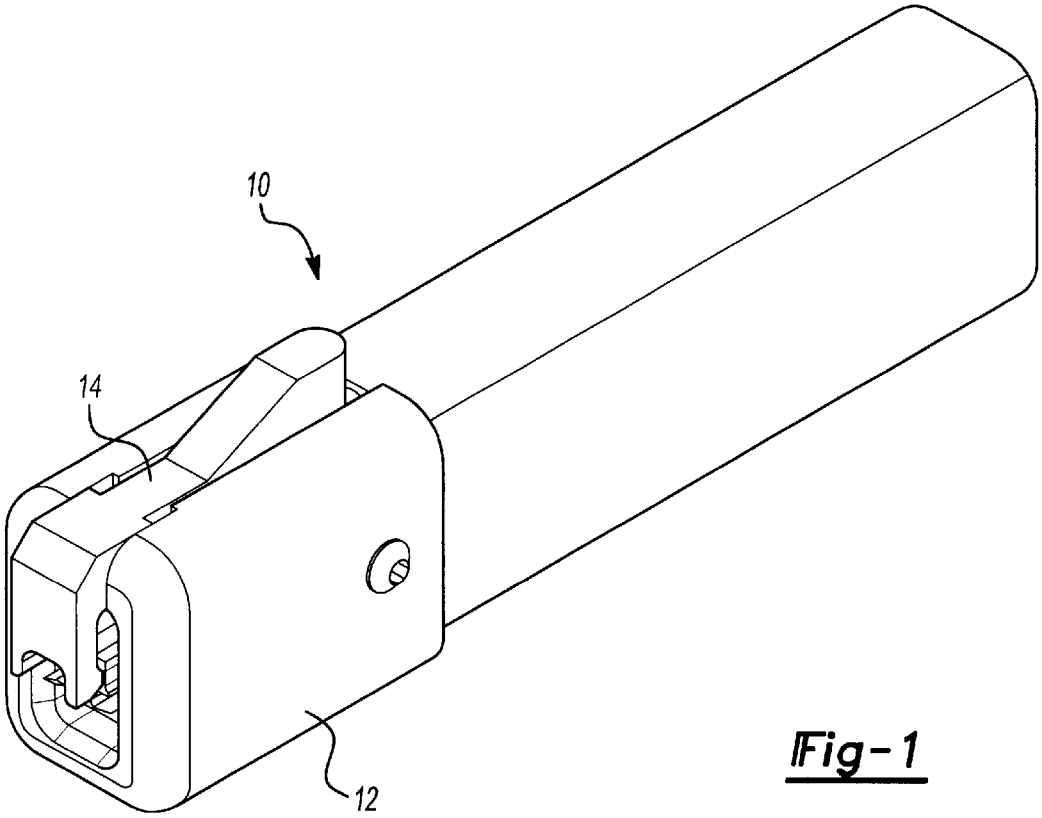
FIG. 1 is a perspective view of one connector of the present invention.

Referring now to FIG. 1, there is shown a perspective view of one embodiment of connector 10 structured in accord with the principles of the present invention. The connector 10 includes a housing 12 which is configured to engage a particular shunted terminal assembly. In this regard, the particular configuration of the housing 12 will depend upon the nature of the terminal assembly to which the specific connector is adapted. As shown in FIG. 1, the connector housing 12 further includes a locking latch 14 for securing the connector 10 to a terminal assembly. This locking latch 14 is an optional feature of the present invention; however, it is preferred in specific embodiments since it assures a positive, locked connection between the connector and the terminal assembly.

Figure 2:
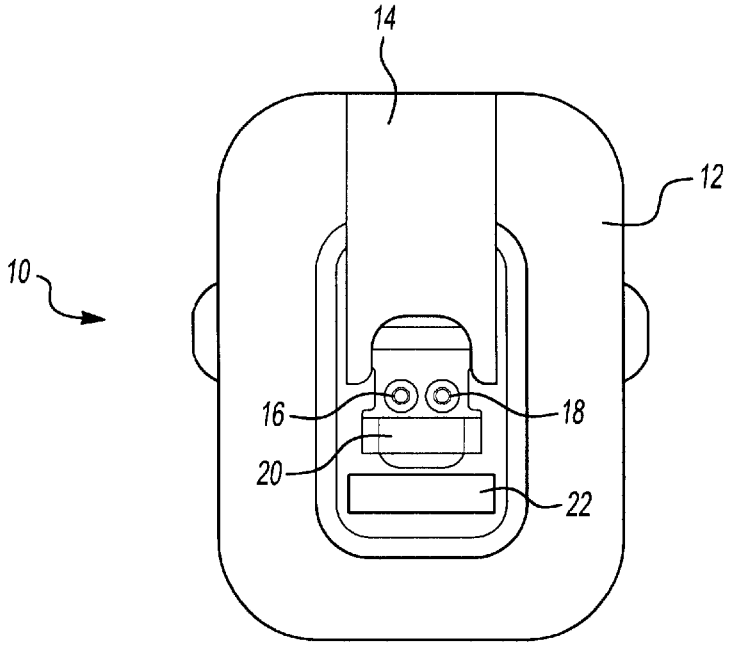
FIG. 2 is a front elevational view of the connector of FIG. 1.

Referring now to FIG. 2, there is shown a front elevational view of the connector 10 of FIG. 1. It is this front face of the connector 10 which engages a corresponding electrical terminal. As will be seen in FIG. 2, the connector 10 includes a housing 12, and in this embodiment, a locking latch 14. Also visible in FIG. 2 are a first 16 and second 18 contact member disposed within the housing. As illustrated herein, these contact members 16, 18 are shown as pin-type members, and are configured to matingly engage with, and establish electrical communication to, corresponding socket type terminals in a terminal assembly. In other embodiments, the contact members may be otherwise configured; for example, the contact members may comprise blade members, socket members, leaf members or the like. Also, it is to be understood that while the FIG. 2 embodiment shows a connector having two contact members 16, 18, connectors of the present invention may have a greater or fewer number of contact members.

Also visible in FIG. 2 is a shunt displacement member 20 which is operative to selectably displace a shunting member in a corresponding terminal assembly. As will be explained in greater detail hereinbelow, the shut displacement member 20 is most preferably mechanically coupled to an actuator, which may be an electrically operated device such as a solenoid, linear actuator, motor or the like, or a fluidically operated device such as a pneumatic or hydraulic piston. The actuator is selectably movable from a first position to a second position. In one of the positions it displaces the shunt member within the terminal, while in the other position it allows the shunt member to return to the shunting position. It will thus be appreciated that by the use of the connector of the present invention, electrical contact between a testing device or the like, and electrical terminals of a pyrotechnical activation device or the like, may be established for both a shunted and unshunted condition. Furthermore, the terminals may be rapidly and repeatably cycled between the shunted and unshunted condition without disengagement of, or relative motion between, the connector of the present invention and the terminal assembly. It will thus be appreciated that the connector of the present invention has significant advantages in connection with the automated testing of pyrotechnical activation circuits and other such devices. The connector of the present invention may be readily integrated into testing equipment and systems, and as such may be in communication with a computer, data logger or the like. Because of the mechanical simplicity of the present device and its ease of use, it may be readily integrated into robotic testing and measuring systems, and may be operated under remote control. These factors are of significant concern with regard to safety, given the inherent danger associated with the testing of pyrotechnical activation circuits.

Also shown in FIG. 2 is an engagement tab 22. This tab projects from a portion of the housing and serves to engage the corresponding terminal assembly to provide a secure mechanical joinder therebetween. This member is not an essential feature of the present invention; and depending upon the particular configuration of the corresponding terminal assembly, may be eliminated or otherwise configured.

Figure 3:
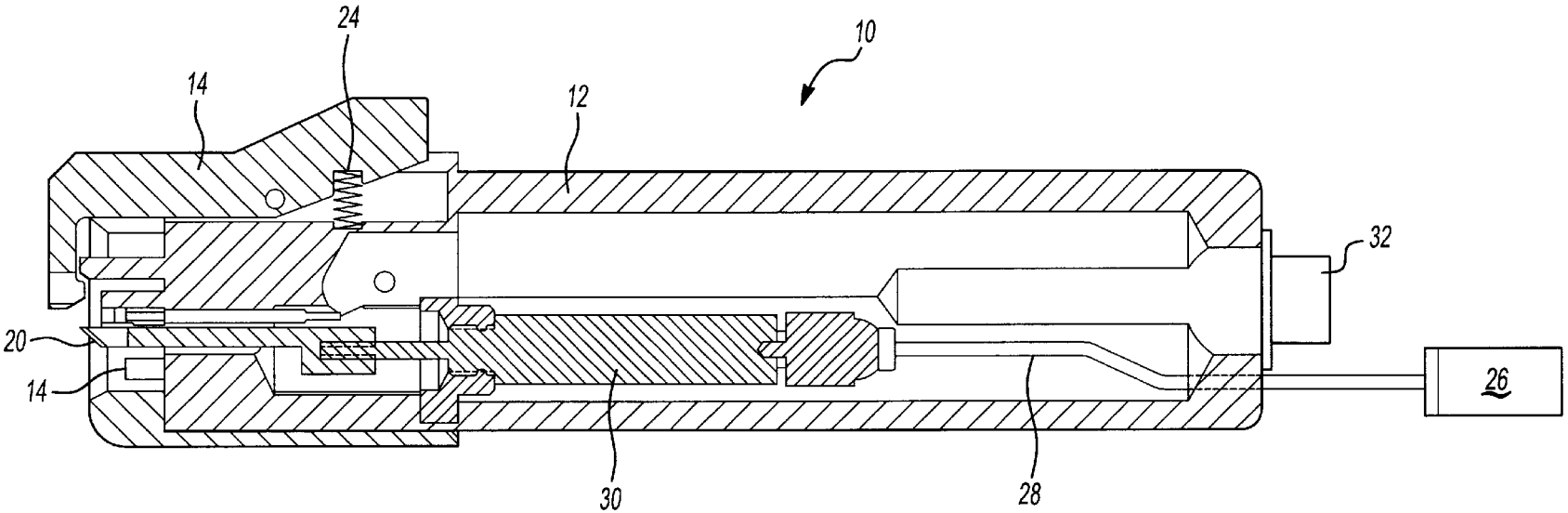
FIG. 3 is a cross-sectional view of the connector of FIG. 1.

Referring now to FIG. 3, there is shown a cross-sectional view of the connector 10 of FIGS. 1 and 2 taken transversely through the connector at a point corresponding to one of the terminals 16 thereof.

As will be seen from FIG. 3, the connector 10 of the present invention includes a housing 12 having a locking latch 14 pivotally supported thereupon, under bias by a spring 24. In this embodiment, the shunt displacement member 20 is in mechanical engagement with a solenoid 26 which is disposed exteriorly of the housing 12. The solenoid 26 actuates a push-pull cable 28 which passes through the housing 12 and which engages a driving member 30 which acts to advance the displacement member 20 upon activation by the solenoid. When the displacement member is in its advanced position, it engages and displaces a shunting member. In most instances, shunting members of shunted terminals are under a resilient bias which returns them to a shunted position; therefore, in this embodiment, when the solenoid 26 is de-energized, the resilient bias of the shunting member will return the displacement member 20 from its advanced position to a retracted position. In those instances where the shunting member is not capable of biasing the displacement member 20 back to a retracted state, a spring, elastic member, or electrically or fluidically powered assist may be provided to retract the displacement member.

Although not shown in FIG. 3, the terminal 16 will generally have an electrical lead which passes through the housing 12, in this instance through a connector socket 32, or the like, so as to allow the connector 16 to communicate with an external test circuit.

Modifications and variations of the foregoing may be implemented in accord with the present invention. For example, the solenoid 26 may be directly incorporated into the housing. Similarly, the solenoid 26 may be replaced by various other actuating devices as discussed hereinabove. Also, the connector of the present invention may include more than one shunt displacement member, and an embodiment of this type is advantageous in those instances where the connector engages a terminal assembly having a plurality of terminals and a plurality of shunting members. In such embodiments, the plurality of shunt displacement members may be activatable on either an individual or an aggregate basis depending upon system requirements.

Figure 4:
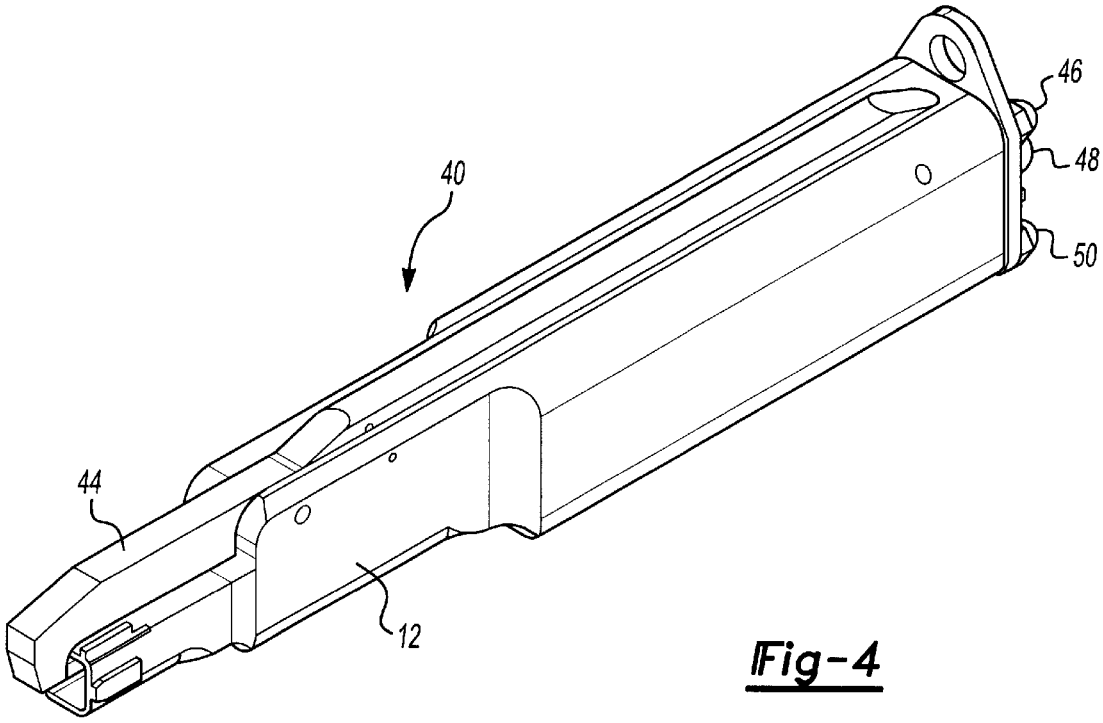
FIG. 4 is a perspective view of another embodiment of connector of the present invention.

Referring now to FIG. 4, there is shown yet another configuration of connector 40 structured in accord with the principles of the present invention. This connector is generally similar to the embodiment of FIGS. 1–3; however, the housing 42 is configured to have an elongate frontward portion so as to allow the connector 40 to engage a specifically configured terminal assembly. As in the foregoing embodiment, the housing 42 includes a locking latch 44 although it is to be understood that this feature may be modified or eliminated. The FIG. 4 embodiment is self contained, insofar as it includes an internal solenoid actuator for advancing and retracting the displacement member. As will be noted from the figure, the connector 40 includes a number of electrical contacts 46, 48, 50 for establishing electrical communication with the contact members and solenoid.

In view of the teaching, yet other embodiments of the connector may be readily implemented by one of skill in the art. Also, it is to be understood that while this connector has been described generally in connection with its use for the testing of pyrotechnical activator circuits, the shunt displacement connector of the present invention will have various other applications in connection with shunted terminals, both in regard to pyrotechnical as well as non-pyrotechnical applications.

In view of the foregoing, it is to be understood that the drawings, discussion and description presented herein are illustrative of specific embodiments of the present invention, but they are not meant to be limitations upon the practice thereof. The following claims, including all equivalents, are what define the scope of the present invention.

What is claimed is:

1. A connector for establishing electrical communication with a shunted electrical terminal assembly of the type comprising a terminal housing having supported therein an electrically conductive terminal member and an electrically conductive shunt member, said shunt member being movable from a first, shunting, position in which it is in electrical communication with said terminal member to a second, unshunted, position where it is not in electrical communication with said terminal member, said connector comprising:

a terminal housing configured to mechanically engage said terminal housing;

an electrically conductive contact member supported by said connector housing, said contact member being disposed and configured to engage, and establish electrical contact with, said terminal member when the connector housing is in mechanical engagement with the terminal housing; and a shunt displacement member supported by the connector housing, said displacement member being selectably activatable when the connector housing is in mechanical engagement with the terminal housing, to move the shunt member from the shunting position to the unshunted position.

2. The connector of claim 1, wherein said displacement member is electrically activatable.

3. The connector of claim 2, wherein said displacement member includes a solenoid which, upon electrical activation, moves the shunt member.

4. The connector of claim 1, wherein displacement member is fluidically activatable.

5. The connector of claim 4, wherein said displacement member is hydraulically activatable.

6. The connector of claim 4, wherein said displacement member is pneumatically activatable.

7. The connector of claim 2, wherein said displacement member is a linear actuator.

8. The connector of claim 1, wherein said terminal assembly includes at least two electrically conductive terminal members and wherein when said shunt member is in said shunting position it establishes electrical communication between said two terminal members, and when in said unshunted position, it does not establish electrical communication between said two terminal members; wherein, said connector includes a first contact member which is configured to engage the first terminal member, and a second contact member which is configured to engage the second terminal member.

9. The connector of claim 1, wherein said connector housing further includes a locking latch for locking said connector housing to said terminal housing.

10. A method for testing a shunted electrical terminal assembly of the type comprising a terminal housing having supported therein an electrically conductive terminal member and an electrically conductive shunt member, said shunt member being movable from a shunting position in which it is in electrical communication with said terminal member to an unshunted position where it is not in electrical communication with said terminal member, said method comprising the steps of:

providing an electrical connector comprising:

a connector housing configured to mechanically engage said terminal housing;

an electrically conductive contact member supported by said connector housing, said contact member being disposed and configured to engage, and establish electrical contact with, said terminal member when the connector housing is in mechanical engagement with the terminal housing; and a shunt displacement member supported by the connector housing, said displacement member being selectably activatable, when the connector housing is in mechanical engagement with the terminal housing, to move the shunt member from the shunting position to the unshunted position;

mechanically engaging the connector housing to the terminal housing so that the contact member is in electrical communication with the terminal member;

electrically connecting the contact member to a test circuit so that said test circuit is in electrical communication with the terminal member;

testing an electrical parameter of said terminal member while said shunt member is in a first one of said shunted or unshunted position;

activating said shunt displacement member so as to displace said shunt from said first one of said shunting or unshunted positions to the other of said shunting or unshunted positions; and measuring a second electrical parameter of said terminal when said shunting member is in the other of said shunting or unshunted positions.

11. A connector for establishing electrical communication with a shunted electrical terminal assembly of the type comprising a terminal housing having supported therein an electrically conductive terminal member and an electrically conductive shunt member, said shunt member being movable from a first, shunting, position in which it is in electrical communication with said terminal member to a second, unshunted, position where it is not in electrical communication with said terminal member, said connector comprising:

a terminal housing configured to mechanically engage said terminal housing;

an electrically conductive contact member supported by said connector housing, said contact member being disposed and configured to engage, and establish electrical contact with, said terminal member when the connector housing is in mechanical engagement with the terminal housing; and a remotely activatable shunt displacement member supported by the connector housing, said displacement member being selectably activatable when the connector housing is in mechanical engagement with the terminal housing, to move the shunt member from the shunting position to the unshunted position.

12. The connector of claim 11, wherein said displacement member is electrically activatable.

13. The connector of claim 12, wherein said displacement member includes a solenoid which, upon electrical activation, moves the shunt member.

14. The connector of claim 11, wherein said displacement member is fluidically activatable.

15. The connector of claim 14, wherein said displacement member is hydraulically activatable.

16. The connector of claim 14, wherein said displacement member is pneumatically activatable.

17. The connector of claim 12, wherein said displacement member is a linear actuator.

* * * * *

UNITED STATES PATENT AND TRADEMARK OFFICE

CERTIFICATE OF CORRECTION

PATENT NO. : 6,632,099 B2
DATED : October 14, 2003
INVENTOR(S) : Rygwelski

It is certified that error appears in the above-identified patent and that said Letters Patent is hereby corrected as shown below:

Column 5,
Line 52, replace “terminal” with -- connector --.
Line 53, replace “housing” insert -- wherein said terminal member is in electrical communication with pyrotechnical actuator --.
Line 59, after “housing” insert -- , and said contact member being in electrical communication with a tes circuit for testing said pyrotechnical actuation --.

Signed and Sealed this

Eighth Day of June, 2004

JON W. DUDAS
*Acting Director of the United States Patent and Trademark Office*